US005567930A

United States Patent [19]

Melton

[11] Patent Number: 5,567,930

[45] Date of Patent: Oct. 22, 1996

[54] SENSOR APPARATUS FOR DETECTING A DISPLACEMENT OF AN OBJECT IN A VISUALLY OBSCURED ENVIRONMENT

[75] Inventor: Roy B. Melton, Pottstown, Pa.

[73] Assignee: The West Company, Incorporated, Lionville, Pa.

[21] Appl. No.: 468,469

[22] Filed: Jun. 6, 1995

[51] Int. Cl.[6] ..... H01J 3/14

[52] U.S. Cl. ..... 250/216; 250/559.3

[58] Field of Search ..... 250/216, 559.3, 250/559.37; 356/437–439, 159; 359/509, 507

[56] References Cited

U.S. PATENT DOCUMENTS

| | | | |
|---|---|---|---|
| 2,691,737 | 10/1954 | Holby | 356/439 |
| 3,906,240 | 9/1975 | Jeffree | 250/239 |
| 4,355,495 | 10/1982 | Lewis et al. | 53/579 |
| 4,953,575 | 9/1990 | Tervamäki | 134/57 R |
| 5,065,009 | 11/1991 | Aoki | 250/222.1 |
| 5,172,572 | 12/1992 | Ono | 68/12.02 |
| 5,239,182 | 8/1993 | Tateyama et al. | 250/559.3 |
| 5,291,025 | 3/1994 | Smith | 250/559.29 |
| 5,293,888 | 3/1994 | Avelis et al. | 134/68 |
| 5,449,912 | 9/1995 | Mayer | 356/437 |

*Primary Examiner*—Que T. Le

*Attorney, Agent, or Firm*—Panitch Schwarze Jacobs & Nadel, P.C.

[57] ABSTRACT

A sensor apparatus detects displacement of an object in a visually obscured environment. The sensor apparatus includes a tube having a first open end, a second open end and a hollow interior. The tube is in contact with the object. A pressurized gas port is located on the tube in fluid communication with the hollow interior of the tube. A photo-emitter is located adjacent to the first end of the tube, in an aligned position with the first and second ends of the tube. A photo-receiver is located adjacent to the second end of the tube, in an aligned position with the first and second tube ends and the photo-emitter. Movement of either sensor or the tube disrupts the beam between the emitter and receiver. The sensor apparatus has mounting brackets which permit it to be supplied separately as an improvement to a vial washer.

10 Claims, 3 Drawing Sheets

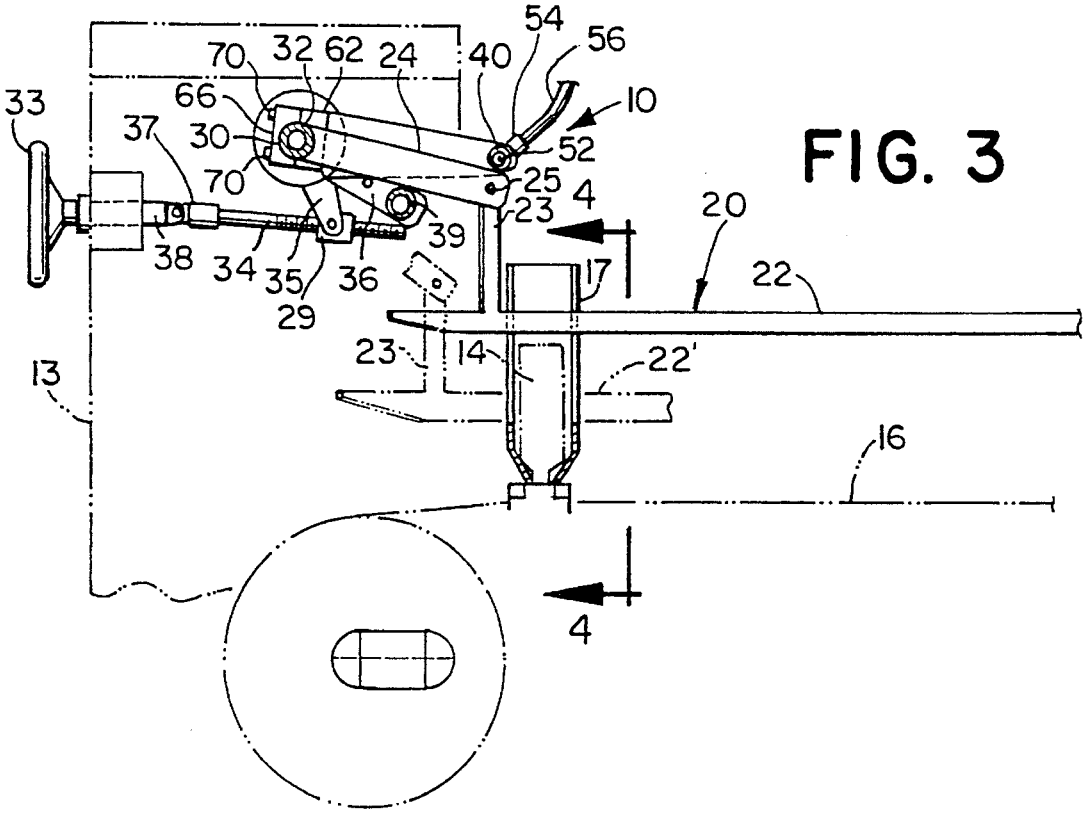
FIG. 3
FIG. 5
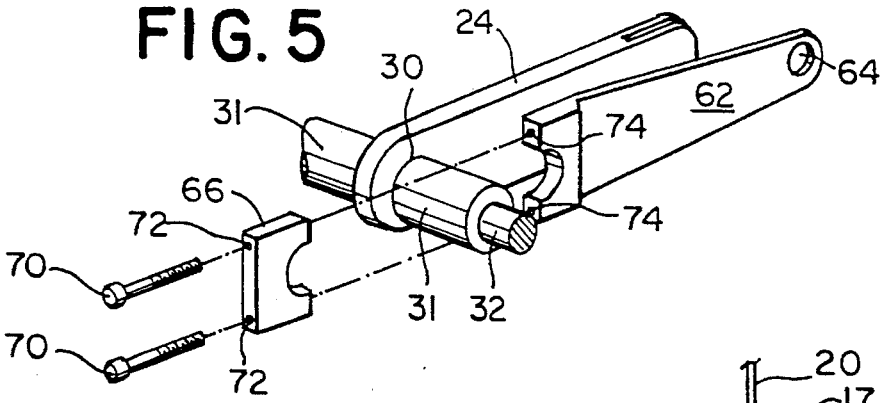
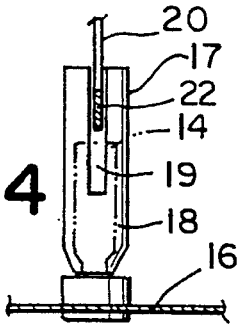
FIG. 4

SENSOR APPARATUS FOR DETECTING A DISPLACEMENT OF AN OBJECT IN A VISUALLY OBSCURED ENVIRONMENT

FIELD OF THE INVENTION

The present invention relates to a sensor apparatus for detecting displacement of an object in a visually obscured environment. More particularly, the present invention is directed to a hold-down bar sensor assembly for a vial washer which detects when a vial is mispositioned in its holder as the vial is carried into the vial washer.

BACKGROUND OF THE INVENTION

In the pharmaceutical industry, pharmaceutical compounds which are placed in vials must remain as pure as possible in order to ensure that the pharmaceutical compounds are effective when used. Vials and/or other small containers must be thoroughly cleaned and sterilized prior to being filled with pharmaceuticals to prevent contamination of the pharmaceuticals from residues, dust or other impurities on or in the vials.

One type of vial washer which is commonly used in the industry is an endless belt vial washer. Vials are inserted upside down into vial holder cups attached to the endless belt such that the open top of the vials face downward. The belt carries the vials through a series of cleaning stages where the vials are cleaned with steam or other cleaning fluids from above and below, and then blown dry. The cleaned vials are then unloaded from the holders and carried to a separate sterilization tunnel where the vials are sterilized.

In order to ensure that the vials are properly cleaned, the vials must be in an inverted position when they are inserted in the vial holder cups. If a vial is not inverted, it will hold cleaning fluid, and will potentially contaminate other vials if not immediately removed, and would clearly be unsatisfactory itself for further processing. The vial holder cups are provided with a tapered bottom portion, and, based on the reduced diameter of the open top of the vial in comparison to the closed bottom, if a vial is not properly inserted into a given vial holder cup, it will sit at a higher position in the vial holder cup than a properly inserted vial.

In order to detect when a vial has been improperly inserted into a holder cup, hold-down bars are pivotally mounted at a height of up to about ⅛ inch above bottoms of the inverted vials. A hold down bar is typically positioned above each row of vial holder cups, with the hold down bar being located in aligned slots in the row of cups. If a vial is improperly inserted into a vial holder cup, the improperly inserted vial contacts the hold-down bar, activating a sensor. The vial washer is then stopped until the vial is properly repositioned.

In the known vial washers, the position of the hold-down bars is sensed utilizing a photo-emitter and a photo-receiver positioned on opposite sides of the vial wash area. A beam of light is directed from the photo-emitter to the photo-receiver. If a hold-down bar becomes displaced due to an improperly positioned vial, the displaced hold-down bar interrupts the beam of light between the photo-emitter and the photo-receiver, signaling the vial washer to shut down until the vial is properly repositioned or removed.

Because the generally known vial washer assemblies have between 18 and 37 hold-down bars and, depending on the application, are 24–48 inches wide, the light beam must travel this distance unobstructed for the washer to operate automatically. However, during start-up, the vial washing area is more foggy than during normal washing operations due to steam and condensation being directed through the belt into the empty vial holders prior to vials being loaded. The excess steam and condensation can interrupt the beam from the photo-emitter to the photo receiver, resulting in a false signal indicating that a hold-down bar is out of place, when in fact the light beam between the photo-emitter and receiver has been interrupted by the steam or condensation inside the vial washer itself. The vial washer is then automatically shut down and the sensors must be overridden in order to successfully restart the cleaning operation.

The present invention is a result of observation of the problems with the prior art devices and efforts to solve them by providing a more reliable sensor assembly which detects when a vial is improperly inserted in a vial holder, but will not give a false signal due to visually obscuring environmental conditions such as steam and/or condensation.

SUMMARY OF THE INVENTION

Briefly stated, the present invention comprises a sensor apparatus for detecting displacement of an object in a visually obscured environment. The sensor apparatus includes a tube having a first open end, a second open end and a hollow interior. The tube is in contact with the object. A pressurized gas port is located on the tube in fluid communication with the hollow interior of the tube. A photo-emitter is located adjacent to the first open end of the tube, in an aligned position with the first and second open ends of the tube. A photo-receiver is located adjacent to the second open end of the tube, in an aligned position with the photo-emitter.

In another aspect, the present invention is a sensor apparatus which can be supplied separately as an improvement to a vial washer.

BRIEF DESCRIPTION OF THE DRAWINGS

The foregoing summary, as well as the following detailed description of preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings:

FIG. 3 is a section view taken along line 3—3 in FIG. 2;

FIG. 4 is a section view taken along line 4—4 in FIG. 3; and

FIG. 5 is a partial enlarged perspective view illustrating the installation of a support link.

DETAILED DESCRIPTION OF PREFERRED EMBODIMENTS

Figure 1:
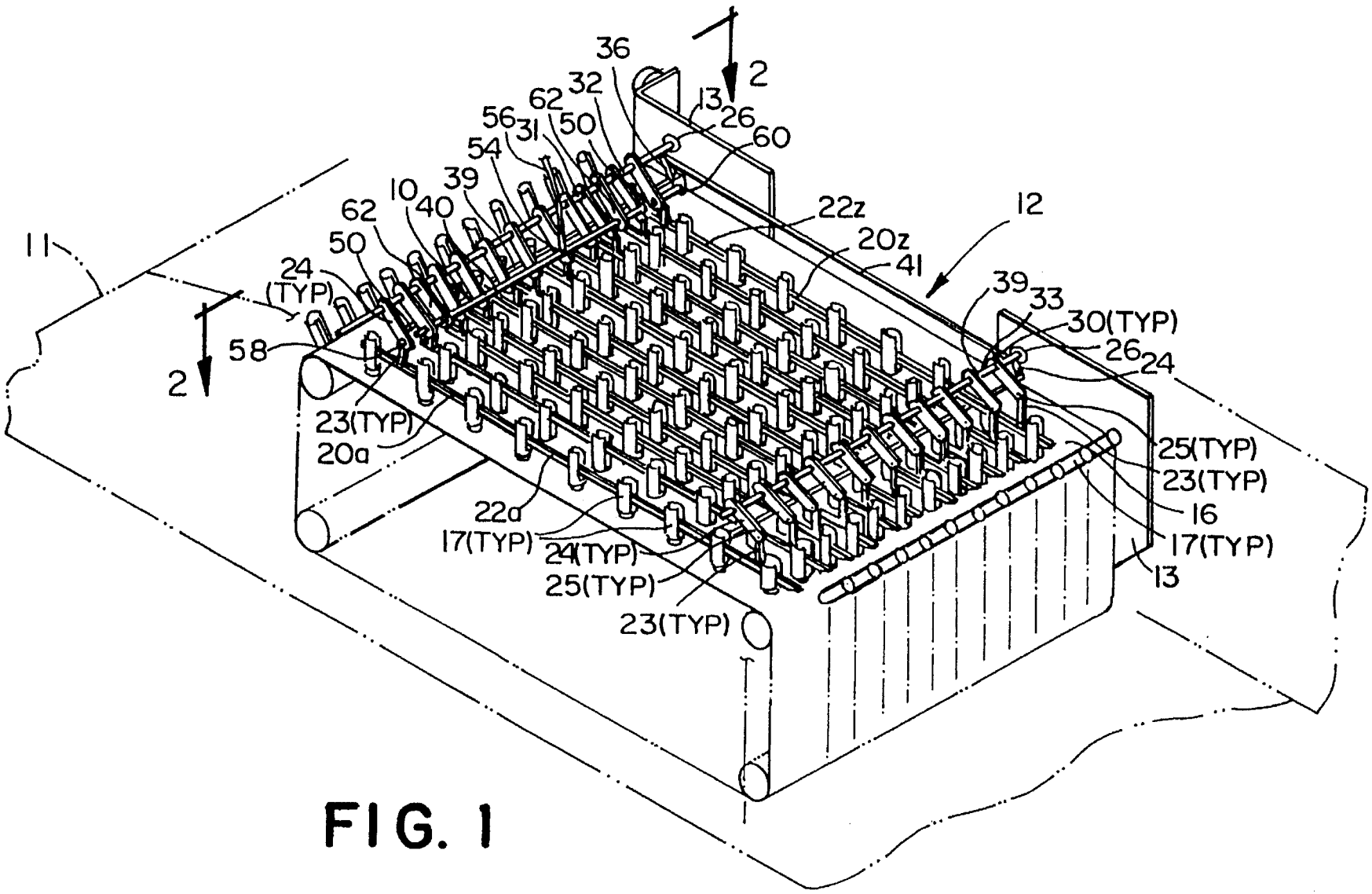
FIG. 1 is a perspective view of a vial washing portion of a vial washer having a sensor apparatus in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the stated apparatus and designated parts thereof. The terminology includes the words above specifically mentioned, derivatives thereof and words of similar import.

Referring to the drawings, wherein like numerals indicate like elements throughout and multiple identical elements in the same Figure have been designated as typical (i.e. "typ"), there is shown in FIGS. 1–5 a preferred embodiment of a sensor apparatus 10 in accordance with the present invention. In the preferred embodiment, the sensor apparatus 10 is used to sense the position of a plurality of hold-down bar assemblies 20 in a washing area 12 (indicated generally in FIG. 1) of a vial washer 11 (partially shown in phantom) which is used for cleaning pharmaceutical vials 14. A conveyor in the form of a moving belt 16 with aligned rows of vial holder cups 17 mounted thereto travels through the washing area 12 of the vial washer. Preferably, the moving belt 16 is formed from two roller chains (not shown) with a plurality of slats (not shown) mounted between the roller chains. As shown in FIG. 4, the cups 17 each have a side wall 18 with two aligned slots 19 defined therethrough.

Referring to FIGS. 1–4, at least one vial hold-down bar assembly 20 is mounted above the conveyor 16. Preferably, the hold-down bar assembly 20 includes a hold-down bar 22, having a support member 23 located in close proximity to each end. The hold-down bar 22 is pivotally mounted on a linkage above the vial holder cups 17 by hold-down bar links 24, which are pivotally connected to the support members 23 at each end of the hold-down bar 22 by a pin 25. Each pin 25 is inserted through apertures defined in the support members 23 and a first end of each hold-down bar link 24. The second end of each hold-down bar link 24 includes an aperture 30 which is pivotally disposed on a shaft 32 located at a first end of the belt 16 or a shaft 33 located at the second end of the belt 16. The shafts 32 and 33 are pivotally mounted in bearings 26 affixed to the support structure 13 of the vial washer on either side of the conveyor belt 16.

Figure 2:
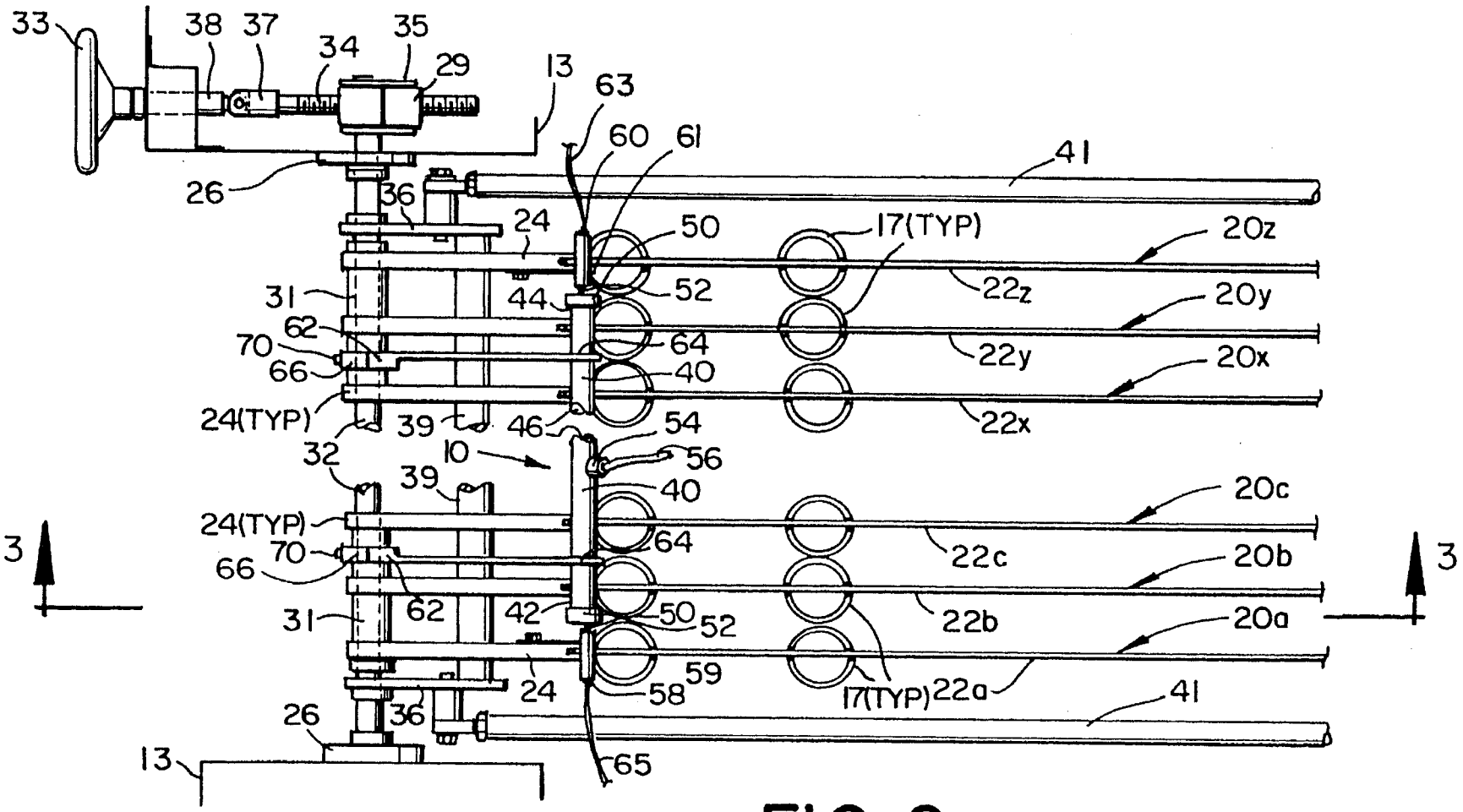
FIG. 2 is an enlarged, partial top plan view taken along line 2—2 in FIG. 1.

Referring now to FIGS. 1 and 2, the vial washer preferably includes a plurality of hold-down bar assemblies (designated 20*a*, . . . 20*z*) located such that the hold-down bars (designated 22*a*, . . . 22*z*) pass through the aligned slots 19 in each row of vial holder cups 17 on the belt 16, as shown in FIG. 4. The spacing between the hold-down bar links 24 of adjacent hold-down bar assemblies 20*a*, . . . 20*z* is maintained by spacers 31, shown most clearly in FIG. 2, disposed on the shafts 32 and 33 between adjacent hold-down bar links 24. In the preferred embodiment, the vial washer includes at least three hold-down bar assemblies 20, and preferably, the vial washer includes between eighteen and thirty-six hold-down bar assemblies 20, each adjacent to one another. For the sake of identification only, the first hold-down bar assembly has been designated 20*a* and the last hold-down bar has been designated 20*z*. However, the identifying characters are not intended to infer any limitations on the number of hold-down bar assemblies 20*b*–20*y* between the first and last hold-down bar assemblies 20*a* and 20*z*. The first hold-down bar 22*a* and the last hold-down bar 22*z* are each located adjacent to the two outside edges of the conveyor belt 16.

Referring now to FIGS. 1–3, a support bar 39 is mounted beneath the hold-down bar links 24 at each end of the conveyor belt 16. The support bars 39 are mounted parallel to each other in a plane parallel to the surface of the conveyor belt 16 on arms 36. The arms 36 are rigidly connected to the shafts 32 and 33. As shown by FIGS. 1 and 2, the connecting rods 41 are pivotally connected between the arms 36 along each side of the conveyor belt 16.

Referring now to FIGS. 2 and 3, the shaft 32 on the first end of the belt 16 protrudes through a portion of the structure 13 of the vial washer 11, and a height adjusting arm 35 is affixed to the end of the shaft 32. An internally threaded member 29 is pivotally connected to the end of the adjusting arm 35, and an actuator screw 34 is threadingly engaged in the threaded member 29. A hand crank 33 having a shaft 38 is rotatably mounted to the structure 13 of the vial washer. A universal joint 37 connects the shaft 38 to the actuator screw 34.

Vial washers of this type having hold-down bar assemblies 20 are known to those of ordinary skill in the art. Such vial washers are commercially available from the West Company, the assignee of the present application, under their WVW and SVW model series. Accordingly, further description of the vial washer is not necessary and is not considered limiting. However, it is understood by those of ordinary skill in the art from this disclosure that the present invention is not limited to use in vial washers of the type described above or specifically to vial washers.

Referring now to FIG. 2, the sensor apparatus 10 for detecting a displacement of an object in a visually obscured environment is comprised of a tube 40 having a first open end 42, a second open end 44 and a hollow interior 46. The tube 40 is in contact with the object, or preferably, with at least one hold-down bar link 24 of at least one hold-down bar assembly 20. Preferably, the tube 40 rests on the links 24 for a plurality of hold-down bar assemblies 20*b*–20*y*.

In the preferred embodiment, the tube is approximately ¾ inch in diameter and made of stainless steel and is sized to span hold-down bar assemblies 20*b*–20*y*. However, it is understood by those of ordinary skill in the art from the present disclosure that the tube 40 may be made of other suitable metallic or hydrolysis resistant polymeric materials. Additionally, it is similarly understood that the size of the tube can be varied to suit particular applications.

In the preferred embodiment, two end caps 50, each having an aperture 52 defined therethrough, are disposed on each open end of the tube 40 by being attached to the first and second open ends 42 and 44 of the tube 40. Preferably, the end caps 50 are made of a stainless steel material similar to the tube 40, and the apertures 52 are preferably approximately 0.040 to 0.100 inches in diameter and centered on the axis of the tube 40. Preferably, the end caps 50 are threadingly engaged on the first and second open ends 42 and 44 of the tube 40. However, it us understood by those of ordinary skill in the art from the present disclosure that the end caps 50 may be made of other suitable metallic or non-metallic materials or may be formed together with the tube 40 as a unitary structure or attached to the tube 40 by other suitable means. It is similarly understood that the end caps 52 may be omitted, depending upon the tube diameter, the sensitivity required and the particular application.

Still with reference to FIG. 2, a pressurized gas port 54 is located on the tube 40 in fluid communication with the hollow interior 46 of the tube 40. A pressurized gas line 56 is connected to the gas port 54. In the preferred embodiment, the gas port 54 is a threaded connector adapted for threadingly engaging the end of the pressurized gas line 56, which is connected to a pressurized gas source (now shown). In the preferred embodiment, the pressurized gas is compressed air. However, it is understood by those of ordinary skill in the art from the present disclosure that any type of gas port, such as a quick disconnect coupling, could be utilized if desired.

Referring now to FIGS. 2, 3 and 5, the tube 40 is held in position by two support links 62 located adjacent to the first and second ends 42 and 44. Each support link 62 has a first end with an aperture 64 defined therethrough. The aperture 64 in the first end of the support link 62 is preferably slightly greater in diameter than the outside diameter of the tube 40. A cap 66 is attached to the second end of each support link 62 to provide an attachment provision for each support link 62 to one of the spacers 31 located on the shaft 32. The second end of the support link 62 and the cap 66 are configured such that the cap 66 can be disassembled from the support link 62 by removing fasteners 70 which are installed through apertures 72 in the caps 66 and into threaded apertures 74 in the second end of the support link 62. This allows the support links 62 to be installed without the need for disassembling the shaft 32, the hold-down bar links 24 and spacers 31. Because of the split second end configuration of the support link 62 and support the cap 66, the link 62 can be retrofitted onto existing vial washers over the shaft 32 without the need for disassembling the vial washer 12.

As shown most clearly in FIGS. 1 and 2, a photo-emitter 58 is located adjacent to the first end 42 of the tube 40, in an aligned position with the first and second ends 42 and 44 of the tube 40. Preferably, the emitter 58 is mounted on a bracket 59 attached to the hold-down bar link 24 of the first hold-down bar 22*a*.

Still with reference to FIGS. 1 and 2, a photo-receiver 60 is located adjacent to the second end 44 of the tube 40, in an aligned position with the photo-emitter 58. Preferably, the photo-receiver 60 is supported by a bracket 61 which is attached to the hold-down bar link 24 for the last hold-down bar 22*z* of the last hold-down bar 20*z*.

Preferably, the photo-emitter 58 and the photo-receiver 60 are located in an aligned position with each other and the apertures 52 in the end caps 50 on the tube 40. In the preferred embodiment, the photo-emitter is Telco part no. SMT-4000-MG5M and the photo-receiver Telco part no. SMR-4206-MG5M. However, it is understood by those of ordinary skill in the art from the present disclosure that other photo-emitter/photo-receiver pairs could be used in accordance with the present invention. Additionally, it is similarly understood that the photo-emitter may be a laser diode, LED or other light source and the photo-receiver may be a photo diode, CCD camera or other suitable light sensing device.

Preferably, the emitter 58 and receiver 60 are connected by wires 63 and 65 to an interrupt circuit (not shown), which turns off the vial washer when the beam of light between the photo-emitter 58 and the photo-receiver 60 is interrupted.

A brief description of the operation of the vial washer 12 having a sensor apparatus 10 in accordance with the present invention follows with reference to FIGS. 1–4.

Prior to use, the hold-down bars 22*a*–22*z* must be adjusted to the proper height. As shown in FIG. 2 and 3, the handcrank 33 is used to adjust the height of the hold-down bars 22*a*–22*z* by turning the screw 34 to move the threaded member 29 and the attached arm 35. The arm 35 rotates the shaft 32 and the attached support arms 36 to raise or lower the support bar 39 at the first end of the conveyor belt 16. The connecting rods 41, which are attached between the arms 36 on each side of the conveyor 16, cause the support bar 39 on the second end of the conveyor 16 to be raised or lowered simultaneously with the support bar 39 on the first end of conveyor 16. The support bars 39 are positioned such that the hold-down bars 22*a* 22*z* are located at the proper height, which is preferably less than ⅛ inch above the bottoms of the inverted vials 14 in the vial holder cups 17, as illustrated in FIG. 3. Depending on the size of the vials 14, the hold-down bars 22 can be adjusted to an appropriate position, such as 22' (shown in phantom) for a smaller vial. As the hold-down bar links 24 are raised or lowered, the tube 40, which rests across the tops of the links 24 for the center hold-down bar assemblies 20*b*–20*y*, the photo-emitter 58 attached to the first hold-down bar assembly 20*a*, and the photo-receiver 60 attached to the last hold down bar assembly 20*z* are also raised or lowered such that the photo-emitter 58 and photo-receiver 60 remained aligned with the apertures 52 in the end caps 50 of the tube 40 and with each other.

As the vial washer 11 is turned on, steam and cleaning fluids are processed through the wash area 12 of the vial washer 11. Pressurized gas is provided through gas line 56 to gas port 54 located on the tube 40. The sensor assembly 10 is activated and a light beam travels from the photo-emitter 58 through the aperture 52 in the end cap 50 adjacent to the photo-emitter 58, the tube 40, the aperture 52 in the opposite end cap 50 and impinges upon the photo-receiver 60. The pressurized gas in the tube 40 maintains the interior of the tube 40 free from steam or condensate, and as the pressurized gas exhausts through the apertures 52 in the end caps 50 at each end 42, 44 of the tube 40, the pressurized gas keeps the surfaces of the photo-emitter 58 and the photo-receiver 60 free from condensation.

Vials 14 are then loaded into vial holder cups 17 at the first end of the conveyor 16 in an inverted position such that the bottoms of the vial 14 are facing upward. As the conveyor belt 16 is moved forward, the bottoms of the vials 14 remain just below the hold-down bars 22*a*–22*z* if the vials 14 are properly inserted into the vial holder cups 17. If a vial 14 is improperly inserted with top facing up or is otherwise mislocated in a vial holder cup 17, it contacts and raises the associated hold-down bar 22*a*–22*z*. If the dislodged or mislocated vial is beneath the first or last hold-down bars 22*a* and 22*z* , the first or last hold-down bar 22*a*, 22*z* is shifted upward causing the photo-emitter 58 or the photo-receiver 60 mounted on the hold-down bar link 24 to be moved out of line with the apertures 52 through the end caps 50 on the first and second ends 42 and 44 of the tube 40 and the other emitter/receiver. This interrupts the beam of light between the photo-emitter 58 and the photo-receiver 60, and the vial washer is stopped until the mislocated or displaced vial 14 has been properly repositioned in the vial holder cup 17. If the mislocated vial 14 is located beneath one of the inner hold-down bars 22*b*–22*y*, the particular hold-down bar 22*b*–22*y* is displaced upwardly, causing its associated hold-down bar link 24 to move the tube 40 contacting its upper surface. The tube 40 pivots upward on the support links 62, or is otherwise moved out of position with respect to the photo-emitter 58 and/or photo-receiver 60, causing a misalignment between the apertures 52 in the end caps 50 on the first and/or second ends 42 and 44 of the tube 40 and the photo-emitter 58 and the photo-receiver 60. This misalignment interrupts the light beam, causing the vial washer to shut down until the mislocated or displaced vial 14 is properly repositioned in its respective vial holder cup 17.

It is understood by those of ordinary skill in the art from the present disclosure that using a smaller diameter aperture 52 in the end caps 50 make the sensor assembly more sensitive to misalignment caused by an improperly inserted vial 14.

The positive gas pressure inside the tube 40 prevents steam or condensate from the cleaning process from accumulating inside the tube 40 and inadvertently disrupting the light beam between the photo-emitter 58 and the photo-receiver 60 which would result in a false signal that a vial 14 was out of position.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A sensor apparatus for detecting a displacement of an object in a visually obscured environment comprising:

a tube having a first open end, a second open end and a hollow interior, the tube being in contact with the object;

a pressurized gas port located on the tube in fluid communication with the hollow interior of the tube;

a photo-emitter located adjacent to the first open end of the tube, in an aligned position with the first and second open ends of the tube; and a photo-receiver located adjacent to the second open end of the tube, in an aligned position with the photo-emitter.

2. The apparatus of claim 1 further comprising two end caps, each having an aperture defined therethrough, one end cap being disposed on each end of the tube, the photo-emitter and the photo-receiver being located in an aligned position with the apertures in the end caps.

3. A hold-down bar sensor apparatus for a vial washer, the vial washer having a plurality of vial holders mounted to a conveyor and at least one vial hold-down bar assembly including at least one hold-down bar pivotally mounted on a linkage above the vial holders, the hold-down bar sensor comprising:

a tube having a first end with an aperture, a second end with an aperture and a hollow interior, the tube being in contact with the at least one hold-down bar assembly;

a pressurized gas port located on the tube in fluid communication with the hollow interior of the tube;

a photo-emitter located adjacent to the first end of the tube, in an aligned position with the apertures; and a photo-receiver located adjacent to the second end of the tube, in an aligned position with the apertures and the photo-emitter.

4. The apparatus of claim 3 further comprising two end caps, each having an aperture defined therethrough, one end cap being disposed on each end of the tube, the photo-emitter and the photo-receiver being located in an aligned position with the apertures in the end caps.

5. The apparatus of claim 3 wherein there are at least two additional hold-down bar assemblies located adjacent to each other and the at least one hold-down bar assembly, with first and last hold-down bar assemblies each being located adjacent two outside edges, and wherein the photo-emitter is mounted to the first hold-down bar.

6. The apparatus of claim 4 wherein the photo-receiver is mounted to the last hold-down bar assembly.

7. An improved vial washer having a plurality of vial holders mounted to a conveyor and at least one vial hold-down bar assembly including at least one hold-down bar pivotally mounted on a linkage above the vial holders wherein the improvement comprises:

a tube having a first end with an aperture, a second end with an aperture and a hollow interior, the tube being in contact with at least one hold-down bar, a pressurized gas port located on the tube in fluid communication with the hollow interior of the tube, a photo-emitter located adjacent to the first end of the tube, in an aligned position with the apertures, and a photo-receiver located adjacent to the second end of the tube, in an aligned position with the apertures and the photo emitter.

8. The apparatus of claim 7 further comprising two end caps, each having an aperture defined therethrough, one end cap being disposed on each end of the tube, the photo-emitter and the photo-receiver being located in an aligned position with the apertures in the end caps.

9. The apparatus of claim 7 wherein there are at least two additional hold-down bar assemblies located adjacent to each other and the at least one hold-down bar assembly, with first and last hold-down bar assemblies each being located adjacent two outside edges, and wherein the photo-emitter is mounted to the first hold-down bar.

10. The apparatus of claim 9 wherein the photo-receiver is mounted to the last hold-down bar assembly.

* * * * *